US005606943A

United States Patent [19]

Tamba et al.

[11] Patent Number: 5,606,943

[45] Date of Patent: Mar. 4, 1997

[54] FOUR-CYCLE ENGINE

[75] Inventors: Shinichi Tamba, Kobe; Yoshiro Yamane, Akashi, both of Japan

[73] Assignee: Kawasaki Jukogyo Kabushiki Kaisha, Kobe, Japan

[21] Appl. No.: 689,886

[22] Filed: Aug. 15, 1996

Related U.S. Application Data

[63] Continuation of Ser. No. 336,805, Nov. 9, 1994, abandoned.

[51] Int. Cl.[6] ..... F01M 1/02; F01M 9/10

[52] U.S. Cl. ..... 123/90.23; 123/90.31; 123/90.33; 123/196 CP; 123/196 W; 123/198 C; 184/6.5

[58] Field of Search ..... 123/90.22, 90.23, 123/90.31, 90.33, 90.38, 90.34, 90.6, 196 R, 198 C, 195 R, 196 CP, 196 W; 184/6.5, 6.9

[56] References Cited

U.S. PATENT DOCUMENTS

| | | | |
|---|---|---|---|
| 1,385,104 | 7/1921 | Afanador | 123/90.31 |
| 4,624,227 | 11/1986 | Wiinsche | 123/198 C |
| 4,697,555 | 10/1987 | Fujikawa et al. | 123/90.23 |
| 4,736,717 | 4/1988 | Fujikawa et al. | 123/90.2 |
| 4,984,539 | 1/1991 | Shinoda et al. | 123/196 W |
| 5,090,375 | 2/1992 | Hudson | 123/196 W |
| 5,243,937 | 9/1993 | Imagawa | 123/195 R |
| 5,267,536 | 12/1993 | Imagawa et al. | 123/90.23 |

FOREIGN PATENT DOCUMENTS

| | | |
|---|---|---|
| 3529965A1 | 4/1986 | Germany . |
| 61-229906 | 10/1986 | Japan . |
| 62-191605 | 8/1987 | Japan . |
| 4-209905 | 7/1992 | Japan . |
| 4-93703 | 8/1992 | Japan . |
| 4-93707 | 8/1992 | Japan . |
| 4-117103 | 10/1992 | Japan . |
| 291274 | 5/1928 | United Kingdom . |

*Primary Examiner*—Weilun Lo

*Attorney, Agent, or Firm*—Poms, Smith, Lande & Rose, P.C.

[57] ABSTRACT

A gear 11 on a crankshaft 10 is made to engage with an internal gear 21 having twice the number of teeth of the gear 11, cams 22 are formed on the exterior surface of the internal gear 21, and the cams 22 are connected with valve actuating mechanisms 40 for actuating an exhaust valve 44 and an intake valve 40 to open or close. The gear 11, the internal gear 21, etc. have the function of an oil pump.

8 Claims, 3 Drawing Sheets

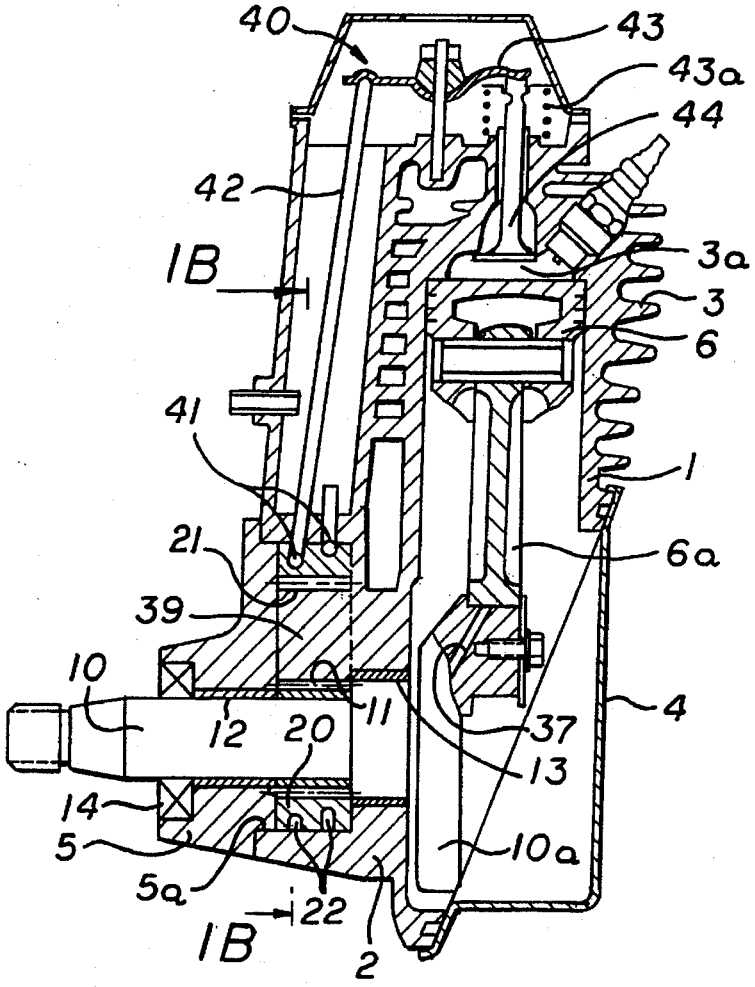
FIG. 1A
FIG. 1B
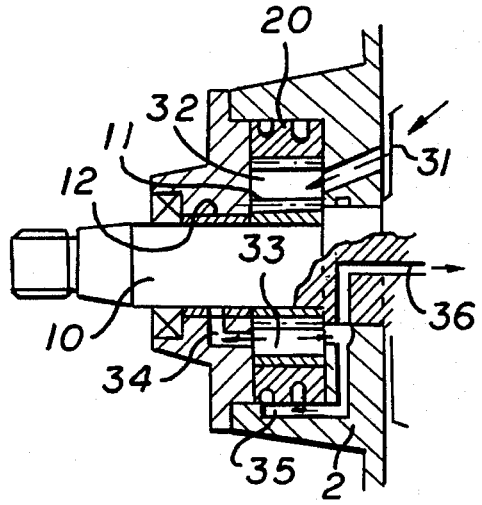
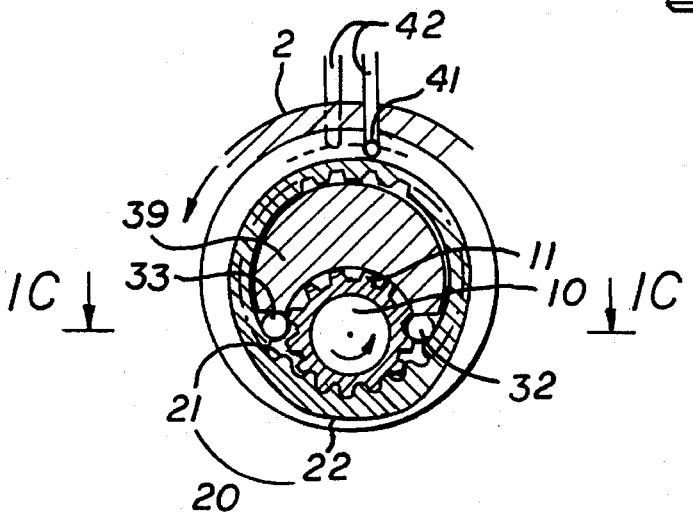
FIG. 1C

FOUR-CYCLE ENGINE

This application is a continuation of U.S. patent application Ser. No. 08/336,805, filed Nov. 9, 1994, now abandoned.

BACKGROUND OF THE INVENTION

1. Field of the Invention

The present invention relates to four-cycle engines and, in particular, small-sized engines integrated into portable machines and the like.

2. Description of the Related Art

Engines integrated into portable machines such as brush cutters and chain saws must be small in size and light in weight. The Japanese Utility Provisional Model Publication No. HEI-4-117103 describes a small-sized four-cycle engine suited to such portable machines. In four-cycle engines, the valves (an intake valve and an exhaust valve) must be opened once each time the crankshaft turns twice. A cam shaft, therefore, for opening and closing the valves is normally provided independent of a crankshaft. The cam shaft receives power from the crankshaft via gears (a crank gear and a cam gear), etc. and turns one half of the number of turns of the crankshaft according to the gear ratio of the gears or the like.

Valve actuating mechanisms such as push rods and rocker arms for valve opening and closing are connected to the cams on the cam shaft, and the intake valve and the exhaust valves are opened and closed at the above-mentioned frequencies. In the engine described in the above-mentioned gazette, a cam shaft is provided independent of the crankshaft.

When a cam shaft is provided for opening and closing valves, the number of parts of an engine will increase by the number of the cam shaft and the related gear, and the weight and size of the engine will increase accordingly. Keeping this point in view, the Japanese Patent Provisional Publication No. SHO-61-229906 proposes a four-cycle engine wherein no cam shaft is used to open or close the intake and exhaust valves. FIG. 4 of the instant application is a longitudinal sectional view of the engine disclosed in the gazette. A special guide portion 11' functioning as an equivalent of the above-mentioned cam is formed on a crankshaft 10' and one end of a valve actuating mechanism 40' is connected (contact engagement) with the surface of the guide portion 11'. The guide portion 11' is in the form of a groove having a route that returns to the starting point after two turns over the external circumference of the crankshaft 10'. A profile similar to a cam is made in the bottom of the groove, said profile having various radii relative to the center of rotation of the crankshaft (the profile curve gives one cycle when turned twice). When the crankshaft 10' is rotated, the valve actuating mechanism 40' will be guided by the guide portion 11' to make one action per two turns of the crankshaft 10'. Thus a valve 44' will be opened and closed at the above-mentioned appropriate frequency.

As the four-cycle engine of said gazette requires no cam shaft nor cam gears, it can be made small in size and light in weight. The engine, yet, has the following margins of improvements:

a) The configuration of the guide portion is complicated. It, therefore, is not easy to form the guide portion. It takes much time to fabricate the portion. Thus it has demerits in terms of production process (delivery time) and cost.

b) The guide portion that turns twice before it returns to the starting point on the crank shafts has a width virtually corresponding to two threads in the axial direction (the direction along the center line of the crankshaft). The crankshaft is longer accordingly, and the casing (crankcase) of the engine is greater as well. Further, the guide portion for the intake valve and the guide portion for the exhaust valve are normally provided on the same crankshaft, independently of each other(a total of two sets), as shown in the drawing. Thus the demerits relating to this point can not be neglected.

c) As mentioned above, each guide portion has an extension in the axial direction, the corresponding part of the valve actuating mechanisms to be guided by the guide portion must travel in the axial direction as well. This means that a joint-like movable part is needed at the ends of the valve-actuating mechanism, resulting in increases in the number of parts, weight and cost accordingly.

d) The guide portions on the crankshaft and the outer bearing away from the oil pan can not be lubricated easily. Therefore, an oil pump is needed to make forced lubrication for above-mentioned portions. The oil pump itself has a certain size, weight and cost.

An objective of the present invention is to provide a light-weight, compact and low-cost four-cycle engine through improvements of the above-mentioned problems.

The four-cycle engine according to the present invention has a gear (an external gear or pinion) on a crankshaft. The gear is made to engage with an internal gear having twice the number of the teeth of the former (engagement inside). Cams are formed on the outer surface of the internal gear, and valve actuating mechanisms are connected to the cams to actuate the intake and exhaust valves to open and close. The internal gear is supported in such a way that the internal gear rotates with its pitch circle constantly being in contact with the pitch circle of the gear on the crankshaft, and the internal gear is located in the casing of the engine. The above-mentioned cams are formed at desired portions of the external surface of the internal gear in such a way that various parts of the cams have different radii relative to the center of rotation thereof and the contact faces of the cams against the valve actuating mechanisms form the desired profile curves. Cams, for example, may be formed into grooves like the case of FIG. 4, being concave relative to other portions. Cams may be formed to be convex, protruding from other portions.

The four-cycle engine of the present invention may be arranged in such a way that the space between said gear and said internal gear is hermetically sealed, a member bisecting the space is placed (with the member, the space on the engaging teeth side is separated from the space on the disengaging teeth side), a suction port of lubricating oil is provided in one of the bisected spaces and a discharge port is provided in the other bisected space, at least one lubricating oil route is connected to the suction port, and at least one lubricating oil route is connected to the discharge port.

Additionally, the crankshaft may be supported by bearings provided at two points across the above-mentioned gear on one side (seen in the axial direction of the crankshaft, one side from the connecting rod) of the cylinder of the single cylinder engine (so-called overhang crank type support).

SUMMARY OF THE INVENTION

In the four-cycle engine according to the present invention, the gear on the crankshaft drives and turns the internal gear which is in engagement with the gear. The valve actuating mechanisms are driven by cams formed on the outer surface of the internal gear to open and close the intake and exhaust valves. The number of teeth of the internal gear is twice the number of teeth of the gear. Hence the internal gear turns once when the crankshaft turns twice. Thus if the above-mentioned cams are normal ones that make one cycle per one turn of the internal gear, the cams can transmit actions to the valve actuating mechanisms at necessary frequencies for a four-cycle engine. Therefore, there is no need of providing complicated guide portions, and the crankshaft and the casing may be made shorter accordingly, and special movable parts such as joints that can move in the axial direction are not required on the portions of the valve actuating mechanisms that are connected with the cams such as the case of FIG. 4, which return to the starting point after two turns.

Since there is no need of providing a cam shaft, independently of the crankshaft, (accordingly, so-called cam gears are not required), the number of parts is smaller than those of the conventional four-cycle engines, and the entire construction is compact and light in weight. Although the engine has an internal gear corresponding to cam gears, the internal gear is hollow and needs no solid shaft portion. It, therefore, is light in weight, and the space is utilized effectively since the gear on the crankshaft is placed inside the hollow portion of the internal gear. In contrast with an ordinary cam shaft having cams located away from the cam gears, the internal gear and the cams are overlapping in the axial direction. This is a reason for a reduced dimension in the axial direction.

In one aspect of the four-cycle engine of the present invention, a function of an oil pump is added to the gear and the internal gear being in engagement as described above. This function is used to feed lubricating oil to the desired points. The space between the gear and the internal gear is hermetically sealed, and the space is bisected to form independent spaces, one on the engaging teeth side and the other on the disengaging teeth side. When each of the two spaces is provided with a lubricating oil route connected thereto, according to the same principle as that of a gear pump used in hydraulic units, lubricating oil is forced out of one space (on the engaging teeth side), and lubricating oil is sucked into the other space (on the disengaging teeth side). When the former is connected, as the discharge port of lubricating oil, to portions to be lubricated and the latter is connected, as a suction port, to or towards the oil pan, etc., desired points can be force-lubricated without any dedicated oil pump.

In another aspect of the present invention, the four-cycle engine is a single cylinder engine, and the crankshaft is supported by bearings on one side of the cylinder only, in the form of the so-called overhung crank type. The engine is called a "side crank engine". Hence the engine itself is more compact in the axial direction and lighter in weight. The reasons are that the crankshaft can be made shorter by eliminating, on the side without any bearings, a journal and one side part of the crank arm, and that the casing (crankcase) of the engine needs no bearing portion on the above-mentioned side part and the casing does not require a strength sufficient to support the crankshaft. The crankshaft is supported by bearings at two points, and provided the strength of the crankshaft is sufficient against the bending forces, the center of the crankshaft will not be shifted or skewed when subjected to a force from the piston, etc. perpendicular to the axis of the crankshaft. Moreover, it is preferable in that since the two points are located on the both sides of the above-mentioned gear, the engagement between the gear and the internal gear is maintained stably.

DESCRIPTION OF THE DRAWINGS

Other objects, features and advantages of the invention will become readily apparent upon reference to the following detailed description when considered in conjunction with the accompanying drawings, in which like reference numerals designate like parts throughout the figures thereof, and wherein:

FIG. 1 (*a*) is a longitudinal cross-sectional view of a four-cylinder engine of the present invention;

FIG. 1 (*b*) is a cross-sectional view of the engine along the line b—b of FIG. 1 (*a*);

FIG. 1 (*c*) is a cross-sectional view along the line c—c of FIG. 1 (*b*);

DETAILED DESCRIPTION OF THE PREFERRED EMBODIMENTS

Figure 2:
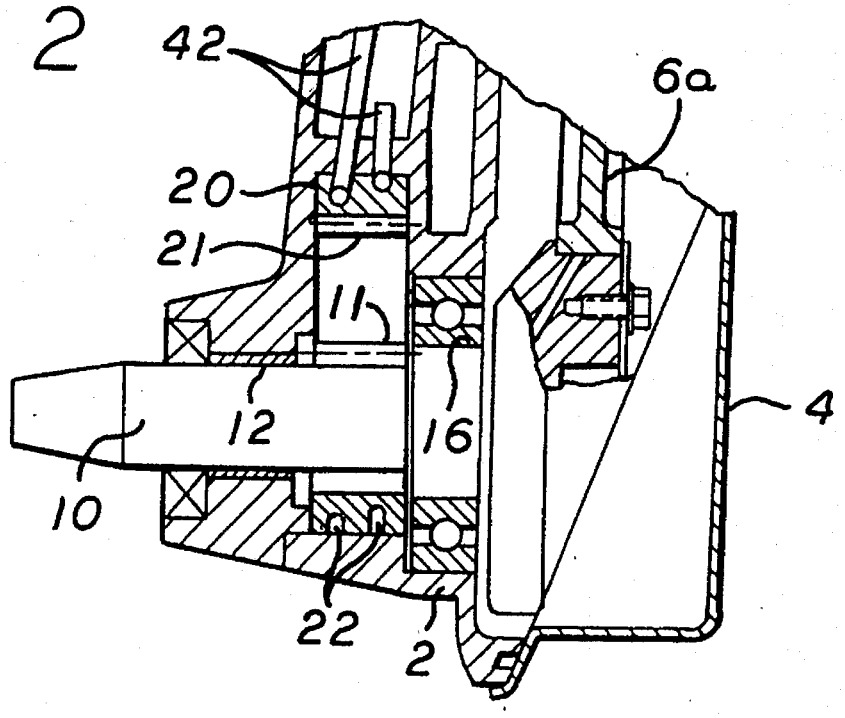
FIG. 2 is a cross-sectional view of an important portion of a second embodiment of the four-cylinder engine of the present invention.

As with conventional engines, the engine of the present invention has a piston 6 and a crankshaft 10 in a cylinder block 1 as shown in FIG. 1 (*a*). The piston 6 is located inside the cylinder 3 within the cylinder block 1, and reciprocates with the explosions of a mixed gas in a combustion chamber 3*a*. Its reciprocating motion is converted, via a connecting rod 6*a* and a crank arm 10*a*, into rotations of the crankshaft 10 and taken out as the output. The introduction of the mixed gas into the cylinder 3 and the exhaustion of the combustion gas are effected by regularly opening and closing valves 44 for intake and exhaust, both located in the upper portion of the combustion chamber 3*a*, by means of valve actuating mechanisms 40 including rocker arms 43 and push rods 42. On the one side of the cylinder block 1, the portion of a crankcase 2 is provided with a crankcase cover 5 including a shaft seal member 14, and the other side of the cylinder block 1 is provided with an oil pan 4.

The engine, as described above, is not particularly different from the conventional ordinary engines. It, however, has the following features designed for reducing the weight, the size and/or the cost.

One feature is the use of a gearing 20 of FIG. 1 (*b*) in place of the conventional cams to regularly transfer driving forces to the valve actuating mechanisms 40. The gearing 20 comprises an internal gear 21 formed therein and groove-like cams 22 (the bottom of each groove has a profile serving as a cam) formed on the external circumferential surface of the internal gear 21. The external circumferential surface (concentric with the pitch circle of the internal gear 21) of the internal gear 21 is fitted in a recess in the crankcase 2 so that the gearing 20 can rotate freely. The internal gear 21 is made to engage with a gear 11 fitted on the crankshaft 10. The number of gear teeth of the internal gear 21 is twice the number of teeth of the gear 11. The profile of the cam 22 is oval like the ordinary cams for opening and closing a valve, and one protruding portion is formed in the circumference. Two cams 22 (two grooves) are formed as shown in FIG. 1 (*a*), with the positions of the protruding portions of the profiles differing from each other. One of the cams 22 is connected to the valve actuating mechanism 40 for intake, and the other to the valve actuating mechanism 40 for exhaust. The connection between the cam 22 and the valve actuating mechanism 40, in this case, is made by providing a roller on the top end 41 of the push rod 42 and pressing the top end 41 against the bottom of the cam 22 by the force of a spring 43*a* of the rocker arm 43.

When the internal gear 21 is rotated by the gear 11 on the crankshaft 10, the cams 22 on the external circumference thereof will actuate the valve actuating mechanisms 40 to open or close the valves 44. According to the above-mentioned gear ratio of the gear 11 to the internal gear 21, the internal gear 21 will turn once while the crankshaft 10 turns twice. Hence the frequencies of the opening and closing of the valves 44 are adequate for the four-cycle engine. Although the valve actuating mechanisms 40 are driven by cams 22, there is no need of providing a cam shaft independently of the crankshaft 10. The cams 22 are provided in the same position with the gearing 20(on the outer surface of the internal gear 21) in the axial direction. Moreover, the gear 11 can be stored in the space inside the gearing 20. With such arrangements, the gearing 20 gives necessary and sufficient actions to the valve actuating mechanisms and contributes to reductions in size, weight, etc. of the engine.

The second feature of the engine is the formation of a kind of gear pump with the above-mentioned gear 11 and internal gear 21, which eliminates the need of any other dedicated oil pump. The space or chamber between the gear 11 and the internal gear 21 is hermetically sealed by enclosing the space with the crankcase 2 and the crankcase cover 5 as shown in FIG. 1 (*a*). A spacer 39 is placed in the space between the gear 11 and the internal gear 21 as shown in FIG. 1 (*b*), and the two spaces partitioned by the spacer 39 are provided with a suction port 32 for lubricating oil and a discharge port 33, respectively. The spacer 39, in this case, is formed integral to the crankcase 2. The lubricating oil is sucked in through the lubricating oil route 31 into the space(suction port 31) created by the disengaging teeth of the gear 11 and the internal gear 21 shown in the right of the drawing as shown in FIG. 1(*b*). Then the sucked lubricating oil fills the teeth spaces of the gear 11 and the internal gear 21 and is carried along the internal and external circumferences of the spacer 39, and will be squeezed in the space-(discharge port 33) in the left of the drawing wherein the teeth are engaging, by the engagement of the gears, and get out of the discharge port 33.

With the gear 11 and the internal gear 21 having the function of an oil pump as described above, the suction port 32 is connected to a lubricating oil pump in the oil pan 4 via the lubricating oil route 31. The discharge port 33 is connected to the necessary lubrication points via lubricating oil routes 34, 35 and 36. The lubricating oil route 34 is one for lubricating the sliding surface of a bearing 12 (located on the distal exterior side from the oil pan 4). The lubricating oil route 35 is one for lubricating the portion between the gearing 20 and the crankcase 2 and the portion between cam 22 and the top end 41 of the push rod 42. The lubricating oil route 36 is one for lubricating, via the route 37 passing through the crankshaft 10 and crank arm 10*a* (see FIG. 1 (*a*)), the internal surface of the cylinder 3, etc. with oil jet produced by the centrifugal force, etc.

With the gear 11, the internal gear 21 and the lubricating oil routes 34, 35 and 36, the portions requiring lubrication can be lubricated without a provision of any other dedicated oil pump. This fact, that any other dedicated oil pump is not necessary, is very favorable in reducing the size, weight and cost of the engine.

The third feature of the engine is that the crankshaft 10 is supported in the form of said overhung crank type so as to make the engine more compact. As shown in FIG. 1 (*a*), the crankshaft 10 is supported by the crankcase 2 via a bush-type bearing 13 between the gear 11 and the crank arm 10*a*, and by the crankcase cover 5 via a bearing 12 of a similar type on the outer side of the gear 11. The crankcase cover 5 is mounted on the external side of the crankcase 2 by means of the fitting of socket and spigot portions 5*a* and fixed by means of bolts (not illustrated). Since the crankshaft 10 is supported at two points by the bearing 12 and the bearing 13, the axis will not be skewed or displaced. Moreover, since the bearings 12 and 13 are placed across the gear 11, the engagement between the gear 11 and the internal gear 21 will be maintained in a desirable condition.

With the adoption of the overhang crank type, the crankshaft 10, as shown in FIG. 1 (*a*), does not need to be extended to the unsupported side (on the right side of the drawing). One side part of the crank arm 10*a* is also eliminated. In a conventional so called center crank type engine, one more bearing must be provided on an oil pan to support a crank shaft and the oil pan must have a sufficient strength to support the bearing. In the engine of the present invention, however, above-mentioned bearing and strength are not necessary, and it is sufficient to mount a simple and light-weight oil pan 4. This naturally results in reductions in the size, weight and cost of the engine.

FIG. 2 is a sectional view of an important portion of a second embodiment of the engine differing in certain points from that of FIG. 1. Portions similar to those of the engine of FIG. 1 are marked with like numbers and will not be described herein. In this engine, the gear 11 and the internal gear 21 are not used as an oil pump (hence there is no spacer 39 which is present in the case of FIG. 1), and a rolling bearing 16 is provided on the internal side closer to the oil pan 4 for supporting an end of the crank shaft 10. Since the gear 11, etc. do not have the function of an oil pump and a rolling bearing having a smaller resistance of rotation is used, the so-called mechanical losses are smaller in the engine, resulting in an engine of a better output efficiency. A dedicated oil pump, however, is needed to lubricate the outer side bearing 12, etc.

Figure 3:
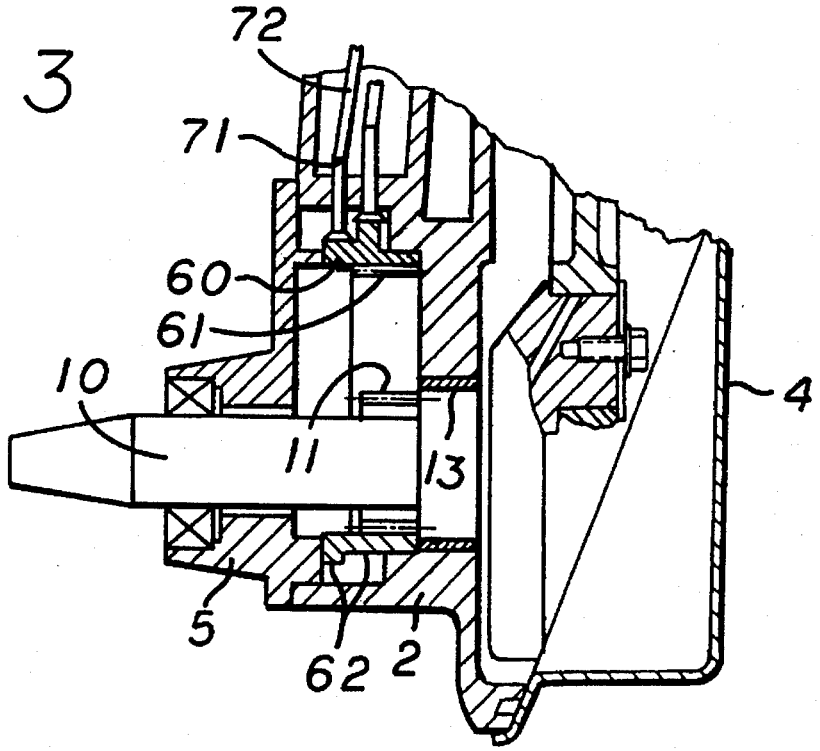
FIG. 3 is a cross-sectional view of an important portion of a third embodiment of the four-cylinder engine of the present invention.
Figure 4:
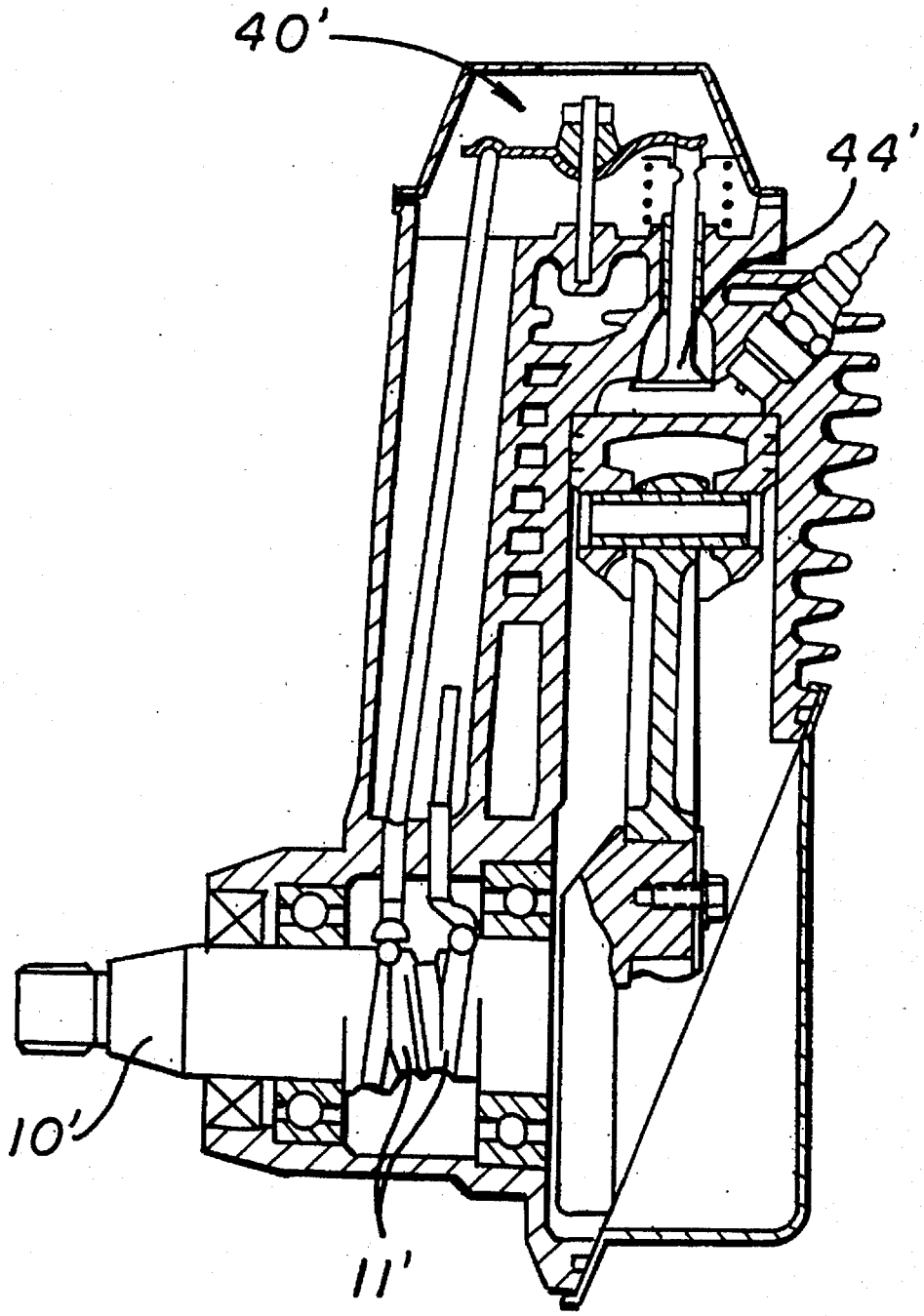
FIG. 4 PRIOR ART
FIG. 4 is a cross-sectional view of a four-cylinder engine in the prior art.

FIG. 3 is a cross sectional view showing an important portion of an engine according to the third embodiment of the present invention. Parts similar to those of FIG. 1 are marked with like numbers. A gearing 60 is provided in place of the gearing 20 of the first embodiment. The gearing 60 comprises an internal gear 61 formed therein to be engaged with a gear 11 on the crankshaft 10 and two lines of cams 62 provided on the external circumferential surface of the internal gear 61 in the form of an outwardly protruding flange rather than a groove. The internal gear 61 is rotatably supported at one end in the axial direction. The number of teeth of the internal gear 61 is twice the number of teeth of the gear 11. Each cam 62 is provided with an protruding portion in the circumference. A driven piece 71 moving up and down according to the movement of the cam 62 is made to slidably contact with the surface of the cam 62 and then connected to the push rod 72. With the rotation of the crankshaft 10, the gearing 60 will turn and, like the other embodiments mentioned above, the valves will be opened and closed regularly.

Three embodiments were introduced, but it should be noted that the present invention is not limited to these embodiments and can be reduced to practice, for example, in the following modes:

a) If the opening and closing intervals for both the intake and exhaust valves are identical to each other, the same profile of cam may be used for the both valves. In this case, the number of cams formed in the outer circumference of the gearing (internal gear) may be one rather than two. Then, driven pieces connected to the respective valve actuating mechanisms may be placed on points of different phases (different angular positions) on the cam.

b) The external circumference itself of the internal gear may be formed directly into a cam or cams rather than providing a groove or a flange with cam profile on the external circumferential surface. In this case, the gearing 60 is supported on a portion of which section is a regular circle rather than the external circumference thereof.

c) The engine type, is not limited to those illustrated in the drawings. The present invention is particularly suitable to vertical shaft engines. When the space between the gear and the internal gear is hermetically sealed, a member for bisecting the spaces provided, a suction port for lubricating oil is provided in one of the bisected spaces, a discharge port is provided in the other bisected space, at least one lubricating oil route is connected to the section port, and at least one lubricating oil route is connected to the discharge port. When the crankshaft is arranged vertical and the gear on the crank shaft and the internal gear (the portions forming an oil pump) are in the lower portion, such parts are constantly immersed in the lubricating oil and it is easy to form lubricating oil routes.

The four-cycle engine according to the present invention have the following merits:

1) Unlike the conventional ordinary four-cycle engines, it does not require the provision of a cam shaft. Hence the number of parts is smaller and the fabrication is easier. Moreover, the engine is more compact and lighter in weight.

2) With regard cams for actuating the valve actuating mechanisms, there is no need of providing such a complicated groove or the like which return to the starting point after two turns. It is sufficient to make a simple one which makes one cycle per turn. Therefore, no extension is required for the cams in the axial direction. The crankshaft and the casing can be made shorter accordingly. No joints that can move in the axial direction are required for the valve actuating mechanisms. It, therefore, is advantageous in terms of fabrication time, cost and so on.

3) The four-cycle engine, as described above in subparagraph "c", can provide forced lubrication of the necessary portions without any other dedicated oil pump.

4) In the four-cylinder engine wherein the crankshaft is supported by providing bearings at two points across the gear on one side of the cylinder of the single cylinder engine, the crankshaft can be made shorter and the casing such as the crankcase can be simplified. It, therefore, is possible to make the engine much more smaller and lighter.

What is claimed is:

1. A four-cycle engine characterized in that a gear on a crankshaft is made to engage with an internal gear having twice the number of teeth of the former gear, cams are formed on the exterior surface of the internal gear, the cams are connected with valve actuating mechanisms for actuating an exhaust valve and an intake valve to open or close, the crankshaft is supported by a crankcase cover of the engine via a first bearing and by a crankcase of the engine via a second bearing, the internal gear is sealed within and directly supported by the crankcase cover and the crankcase, and the first bearing and second bearing are positioned to directly face opposite sides of the gear such that the first bearing and second bearing support the gear and maintain a desired engagement condition between the gear and the internal gear.

2. The four-cycle engine of claim 1 wherein the space between said gear and said internal gear is hermetically sealed, a member for bisecting the space is provided, a suction port for lubricating oil is provided in one of the bisected spaces, a discharge port is provided in the other bisected space, at least one lubricating oil route is connected to the suction port, and at least one lubricating oil route is connected to the discharge port.

3. A four-cycle engine comprising:

a crankshaft positioned within a crankcase and a crankcase cover of the engine, said crankshaft including a crankshaft gear with teeth;

a first bearing positioned between said crankshaft and the crankcase cover such that the crankcase cover supports said crankshaft via said first bearing;

a second bearing positioned between said crankshaft and the crankcase such that the crankcase supports said crankshaft via said second bearing;

an internal gear mechanically coupled to said crankshaft gear, said internal gear including twice the number of teeth of said crankshaft gear, said internal gear including cams on an external surface thereof, said cams being mechanically coupled to a valve actuating mechanism of the engine, said internal gear being sealed within and rotatably supported by the crankcase forming an oil pump constructed from the crankshaft gear and said internal gear;

said first bearing and said second bearing being positioned to directly face opposing sides of said crankshaft gear such that said first and second bearings support said crankshaft gear and maintain a desired engagement condition between said crankshaft gear and said internal gear;

a first oil route from the oil pump directing oil to the cams; and a second oil route from the oil pump directing oil to said first bearing.

4. The four-cycle engine of claim 3 wherein said crankshaft gear and said internal gear define a sealed chamber therebetween, the engine further comprising:

a spacer mechanism positioned in said sealed chamber between said crankshaft gear and said internal gear, said spacer mechanism partitioning said sealed chamber defining a suction port and a discharge port for a lubricating oil.

5. The four-cycle engine of claim 3 wherein said first bearing comprises a bush-type bearing.

6. The four-cycle engine of claim 3 wherein said second bearing comprises a bush-type bearing.

7. The four-cycle engine of claim 3 wherein said second bearing comprises a rolling bearing.

8. A four-cycle engine comprising:

a crankshaft including a crankshaft gear with teeth;

an internal gearing mechanically coupled to said crankshaft gear, said internal gear including cams on an external surface thereof, the cams being mechanically coupled to a valve actuating mechanism of the engine;

a crankcase;

a crankcase cover;

said crankcase rotatably forming a concavity accommodating and rotatably supporting said internal gearing, the concavity being sealed to provide an oil pump constructed from said internal gearing, the crankshaft gear, and a spacer accommodated within the concavity;

a first bearing positioned between said crankshaft and said crankcase cover such that said crankcase cover supports said crankshaft via said first bearing;

a second bearing positioned between said crankshaft and said crankcase such that said crankcase supports said crankshaft via said second bearing;

said first and second bearings being positioned on opposing sides of the crankshaft gear;

a first oil route from the oil pump directing oil to the cams;

a second oil route from the oil pump directing oil to said first bearing; and a third oil route from the oil pump directing oil to said second bearing.

* * * * *